US005280711A

United States Patent [19]

Motta et al.

[11] Patent Number: 5,280,711

[45] Date of Patent: Jan. 25, 1994

[54] LOW COST BEVERAGE DISPENSING APPARATUS

[75] Inventors: Carlos F. C. Motta; Francisco de A. R. Freitas, both of Rio de Janeiro, Brazil

[73] Assignee: IMI Cornelius Inc., Anoka, Minn.

[21] Appl. No.: 23,221

[22] Filed: Feb. 25, 1993

[51] Int. Cl.[5] ..... F25D 17/00

[52] U.S. Cl. ..... 62/177; 62/389; 62/393

[58] Field of Search ..... 62/389, 390, 393, 396, 62/398, 399, 400, 177, 183

[56] References Cited

U.S. PATENT DOCUMENTS 2,162,260 6/1939 Kurpiewski ..... 62/393

3,309,886 3/1967 Welty ..... 62/389

*Primary Examiner*—John M. Sollecito

*Attorney, Agent, or Firm*—Sten Erik Hakanson

[57] ABSTRACT

A beverage dispenser is shown and includes an insulated water bath tank for retaining a plurality of beverage heat exchange coils. The coils deliver the beverage to a plurality of beverage dispensing valves. The water bath tank includes an area for holding an ice retaining basket. The dispenser includes a top access door for permitting removal and replacement of the basket from the tank. An overflow drain serves to maintain the water in the tank at a desired level, and an agitator provides for agitation thereof. In operation, the basket is first removed and filled with ice. The basket is then placed into the tank and the access door closed. Water in the bath is displaced by the basket and ice, and any that rises above the overflow drain level is dispensed there through. The agitator causes movement of the water for faster cooling thereof by heat exchange with the ice, and therefore, faster heat exchange cooling of the beverage coils in the water bath. When the ice has substantially melted, the basket can again be filled with further ice and replaced into the water bath tank.

12 Claims, 7 Drawing Sheets

LOW COST BEVERAGE DISPENSING APPARATUS

BACKGROUND OF THE INVENTION

1. Field of the Invention

The present invention relates generally to beverage dispensing equipment and, in particular, to low cost beverage dispensing equipment.

2. Background of the Invention

Fountain beverage dispensing equipment provides for the dispensing of cold beverages on either a post-mix or pre-mix basis. A post-mix dispenser mixes the beverage constituents, such as carbonated water and syrup, in a desired ratio to produce a carbonated soft drink, whereas the pre-mix dispenser dispenses a previously prepared beverage. In both cases, such equipment must provide for the pre-cooling of the beverage or its constituents prior to dispensing thereof. Cooling can be accomplished directly with a refrigeration system having a compressor, evaporator, condenser, and so forth. However such an approach can be relatively expensive due to the cost of the refrigeration machinery, and the cost associated with the maintenance and operation thereof. Thus, the refrigeration based system is not ideal for retail locations in, for example, a rural area, where there may be a desire or need for fountain dispensed drinks, but where the volume of business can not support or justify a very expensive dispenser. Also, such areas typically lack conveniently located service personnel that can repair and maintain the dispensing equipment for a reasonable cost, and do so in a reasonable period of time.

Beverage dispensers also use cold plate systems where ice is used to cool a metal cold plate which, in turn, provides for cooling of the beverage or beverage constituents by heat exchange therewith. A cold plate based dispenser is not as mechanically complex as a dispenser having a full refrigeration system, and therefore, the maintenance thereof is less involved and less costly. However, the cost of a cold plate dispenser can also be prohibitive in a low volume location.

A further problem occurs where portability of the dispenser is a concern, such as with a unit that is to be used, for example, only temporarily at a particular location, or continually transported in a vehicle from which food and drink are sold. Both cooling approaches result in a dispenser that is relatively heavy, and in the case of one using a refrigeration system, there is a need for a significant amount of electrical power. Moreover, refrigeration equipment is quite sensitive to any shocks that may occur during movement thereof, thus, refrigeration based dispensers are not ideally suited for use in mobile applications.

Accordingly, it would be desirable to have a beverage dispenser that is low in initial cost, and designed to be reliable and easy and inexpensive to operate and maintain. It would also be desirable to have such a dispenser that is durable and easily transported.

SUMMARY OF THE INVENTION

The beverage dispenser of the present invention includes an insulated water bath tank for retaining a plurality of beverage heat exchange coils. The coils deliver the beverage to a plurality of beverage dispensing valves. The water bath tank includes a first area for holding an ice retaining basket and a second area for holding the coils, and in the case of a post-mix dispenser, a carbonator. The basket includes a plurality of holes for permitting fluid exchange of the water between the basket and the second tank area. The dispenser includes a top access door for permitting removal and replacement of the basket from the tank. An overflow drain serves to maintain the water in the tank at a desired level. An agitator includes an agitator motor driving a shaft having a prop or blade on the end thereof. The blade is held below the water surface in the second area above the coils.

In operation, the basket is first removed and filled with ice, either cubes or a single block. The basket is then placed into the tank and the access door closed. Water in the bath is displaced by the basket and ice, and any water that rises above the overflow drain level is dispensed there through. The agitator causes circulation of the water between the first and second areas by action of the agitator blade for faster cooling thereof by heat exchange with the ice, and therefore, faster heat exchange cooling of the beverage coils and carbonator in the water bath. When the ice has substantially melted, the basket can again be filled with further ice and replaced into the water bath tank. A plurality of baskets can be employed wherein a freshly filled basket can be prepared and used to quickly replace a basket in which most or all of the ice has been melted.

It can be appreciated that a traditional ice bank system depends upon the ice being retained in a manner so that an agitator blade can be employed, as too much ice and/or free floating ice particles could damage or prevent the operation of the agitator. Such a system using an ice bank and an agitator, is quite effective in permitting rapid heat exchange, however, as has previously been discussed, the cost of the associated refrigeration equipment can be prohibitive. Thus, the present invention allows for cooling of the dispensed beverage by simulating this very effective heat exchange strategy. In other words, the ice retaining basket can be viewed as an instantly created "ice-bank". That is, the basket retains the ice in essentially a single mass that can be effectively heat exchanged with the beverage coils by the operation of the agitator motor. In fact, it will be understood that any separate ice cubes will melt in the water bath and fuse together so that ice particles will not interfere with the action of the agitator blade. Furthermore, as the ice melts, any free particles that could flow through the basket openings will generally not be produced until most of the ice has been consumed, at which point such small volume of ice particles can float harmlessly at the top of the water bath tank in the basket or in the vicinity of the agitator shaft well away from the blade. Also, the basket provides a convenient means for measuring the desired quantity of ice so as to minimize any water overflow. Moreover, the advantage of using externally produced ice, as used in a cold plate system, is retained, without the associated disadvantages of cost and weight found with a cold plate system. Therefore, the cost of the present invention is greatly reduced with respect to traditional dispensers. Moreover, its relative simplicity of design provides for enhanced durability and reliability.

DESCRIPTION OF THE DRAWINGS

A better understanding of the structure, operation, and objects and advantages of the present invention can be had in view of the following detailed description, which refers to the following figures, wherein.

DETAILED DESCRIPTION OF PREFERRED EMBODIMENTS

Figure 1:
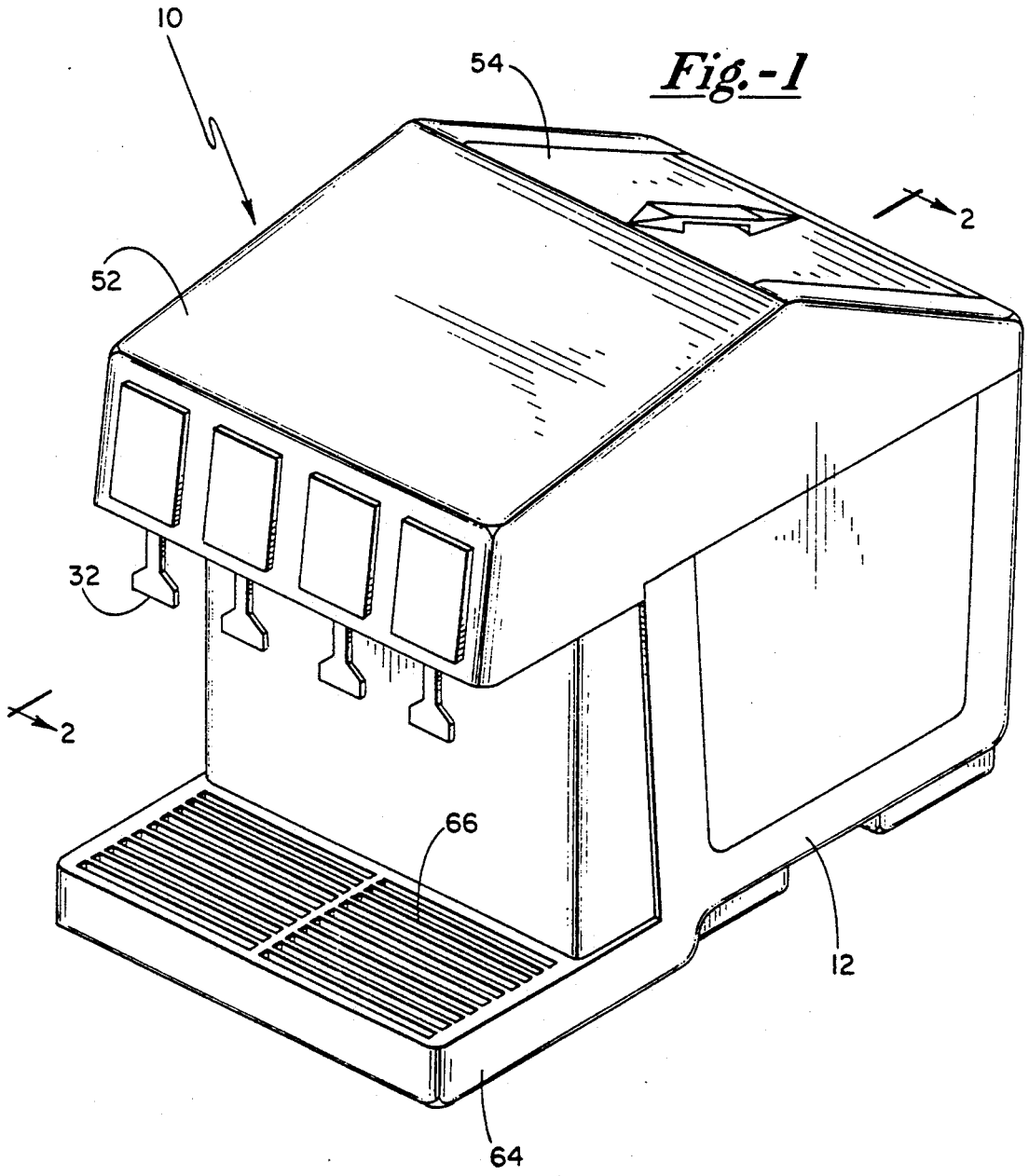
FIG. 1 shows a perspective view of the present invention.
Figure 2:
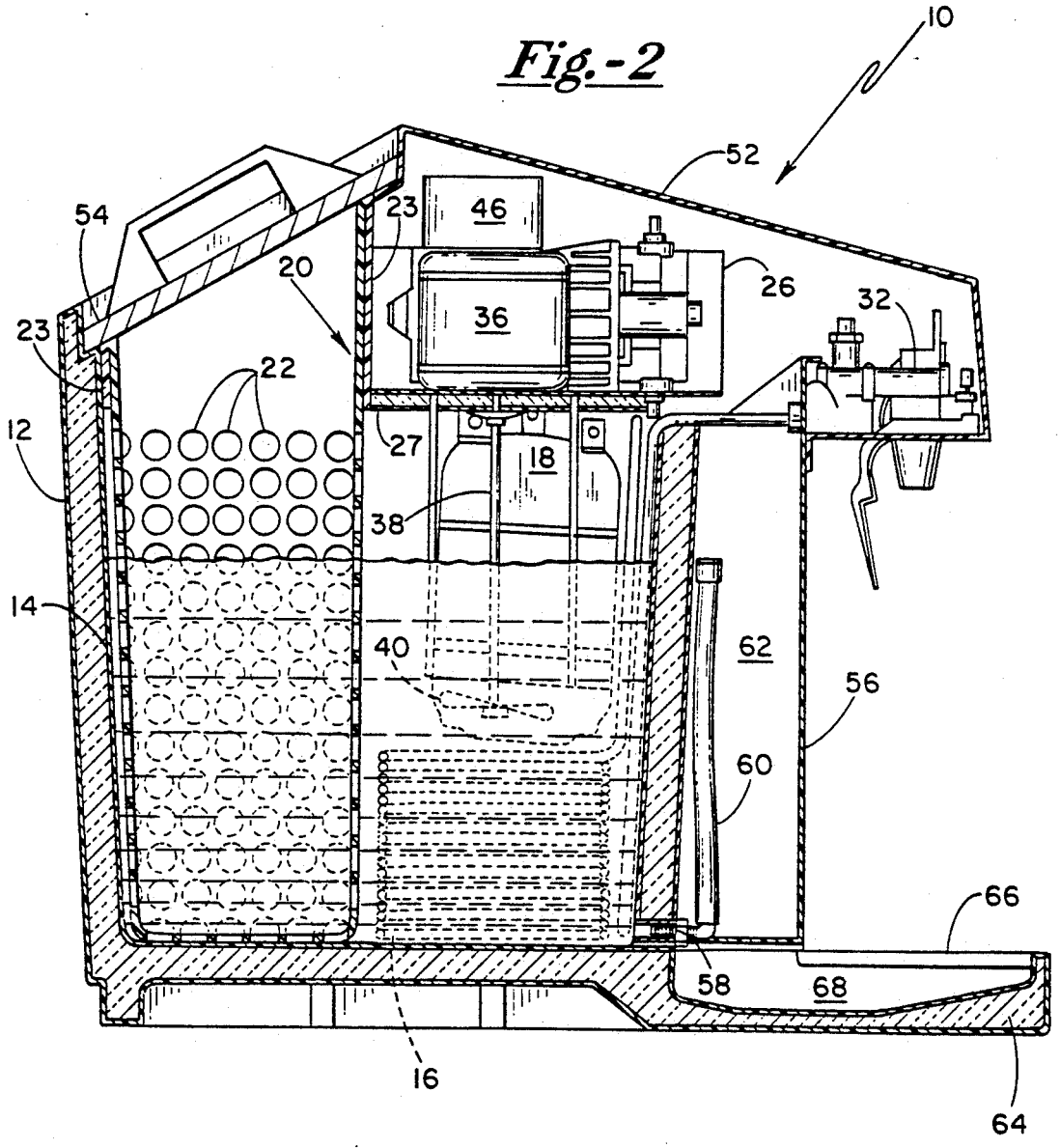
FIG. 2 shows a side cross-sectional view of the present invention.
Figure 3:
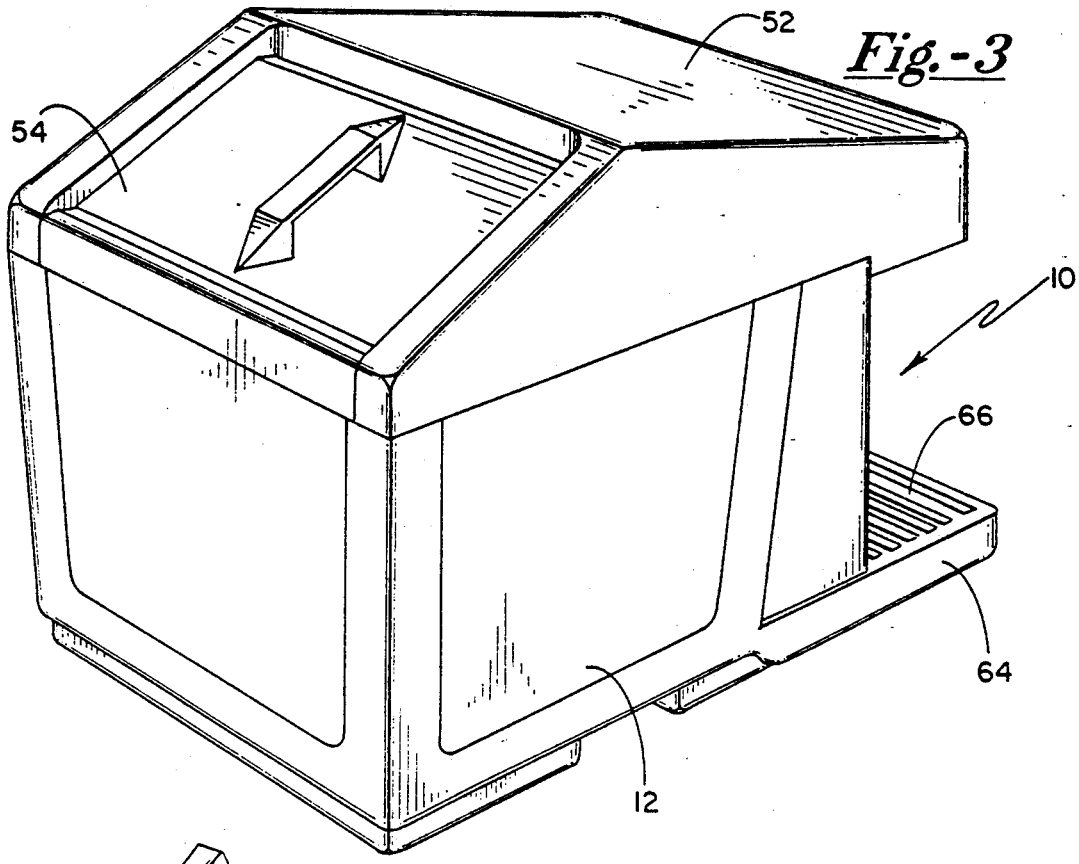
FIG. 3 shows a rear perspective view of the present invention.
Figure 4:
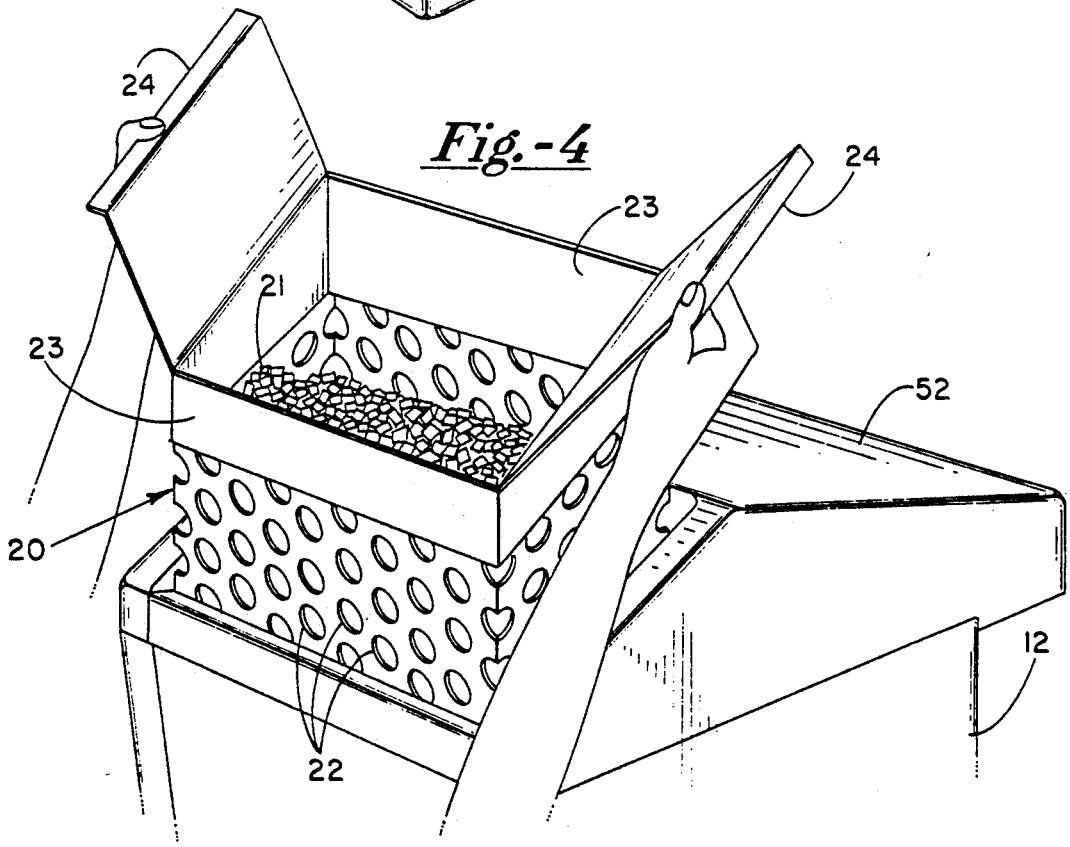
FIG. 4 shows a perspective view of the ice basket of the present invention.

The beverage dispenser of the present invention is seen in FIGS. 1–4, and generally referred to by the numeral 10. Dispenser 10 includes an insulated exterior housing 12 defining a water bath tank 14. Tank 14 holds a plurality of syrup heat exchanging coils 16, a carbonator 18 and an ice retaining basket 20. A basket 20 provides for holding a volume of ice 21, and includes a plurality of holes 22. A top end of basket 20 includes a spacing collar, and the top end thereof can be opened and closed by a pair of doors 24.

Figure 5:
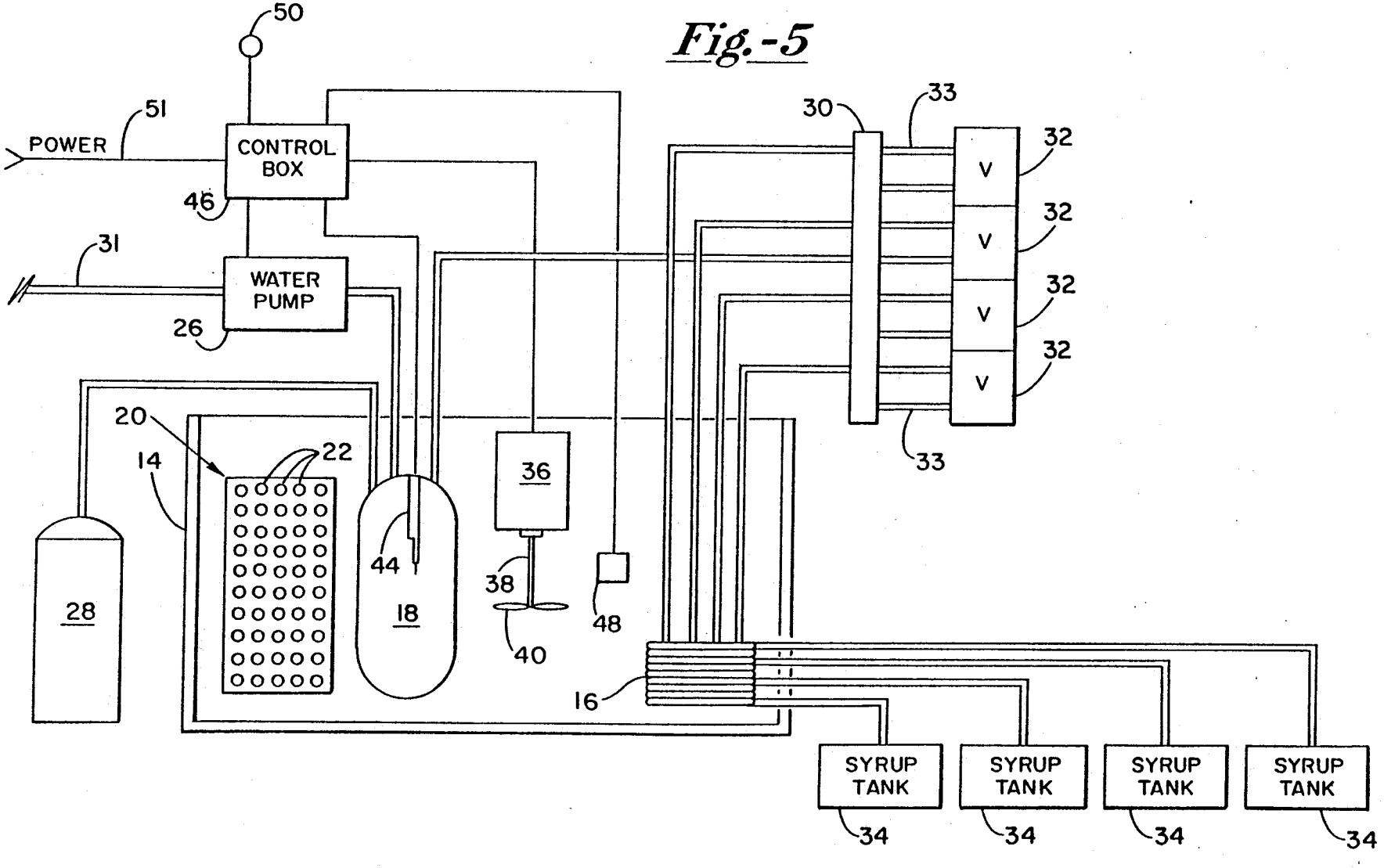
FIG. 5 shows a schematic diagram of the present invention.

As seen by also referring to FIG. 5, carbonator 18 is connected to a water pump 26, a source of compressed carbon dioxide 28, and to a carbonated water manifold 30. Pump 26 is secured to a floor support 29, and is fluidly connected to a potable source of water, not shown, by a water line 31. Manifold 30 is connected to a plurality of manually operated post-mix beverage dispensing valves 32, by lines 33. Valves 32 are also individually connected to the plurality of individual syrup coils 16, which coils 16 are in turn connected to separate sources of syrup 34. An electric agitator motor 36 is also secured to floor 29 and includes a shaft 38 having an agitator blade 40 on an end thereof.

In the preferred embodiment basket 20 occupies approximately one half of the volume of tank 14 The remaining half of tank 14 has the coils 16 located along a bottom portion thereof with carbonator 18 and agitator shaft 38 and blade 40 there above. Blade 40 is held below a surface 42 of water held in tank 14, and in particular, is positioned immediately above coils 16.

Carbonator 18 further includes a liquid level probe 44 held therein. As is known in the art, probe 44 is connected to control means 46 for regulating the operation of pump 26 to automatically replenish carbonator 18 with further water for carbonating thereof as carbonated water is drawn off. A temperature sensing means 48 is held within tank 14 and connected to control means 46, and a high temperature signalling means such as a light 50 is secured to the exterior of dispenser 10 and connected to control means 46. Control means 46 is operated electrically and connected by a line 51 to a source of electrical power.

Dispenser 10 includes an outer top housing 52 secured to a top perimeter thereof. Housing 52 serves to enclose and protect the various internal components of dispenser 10. Housing 52 also includes an insulated access lid 54 that is removably securable thereto and provides for removal and insertion there through of basket 20 int tank 14. A vertical support wall 56 is secured to housing 12 and provides for support of valves 32 secured thereto. Tank 14 has a drain 58 connected to a vertical overflow tube 60. Tube 60 extends vertically within a space 62 defined between wall 56 and housing 12. Housing 12 has a cup rest portion 64 for retaining a grate 66. A space 68 below grate 66 receives any spillage and is in fluid communication with a waste drain, not shown.

Figure 6:
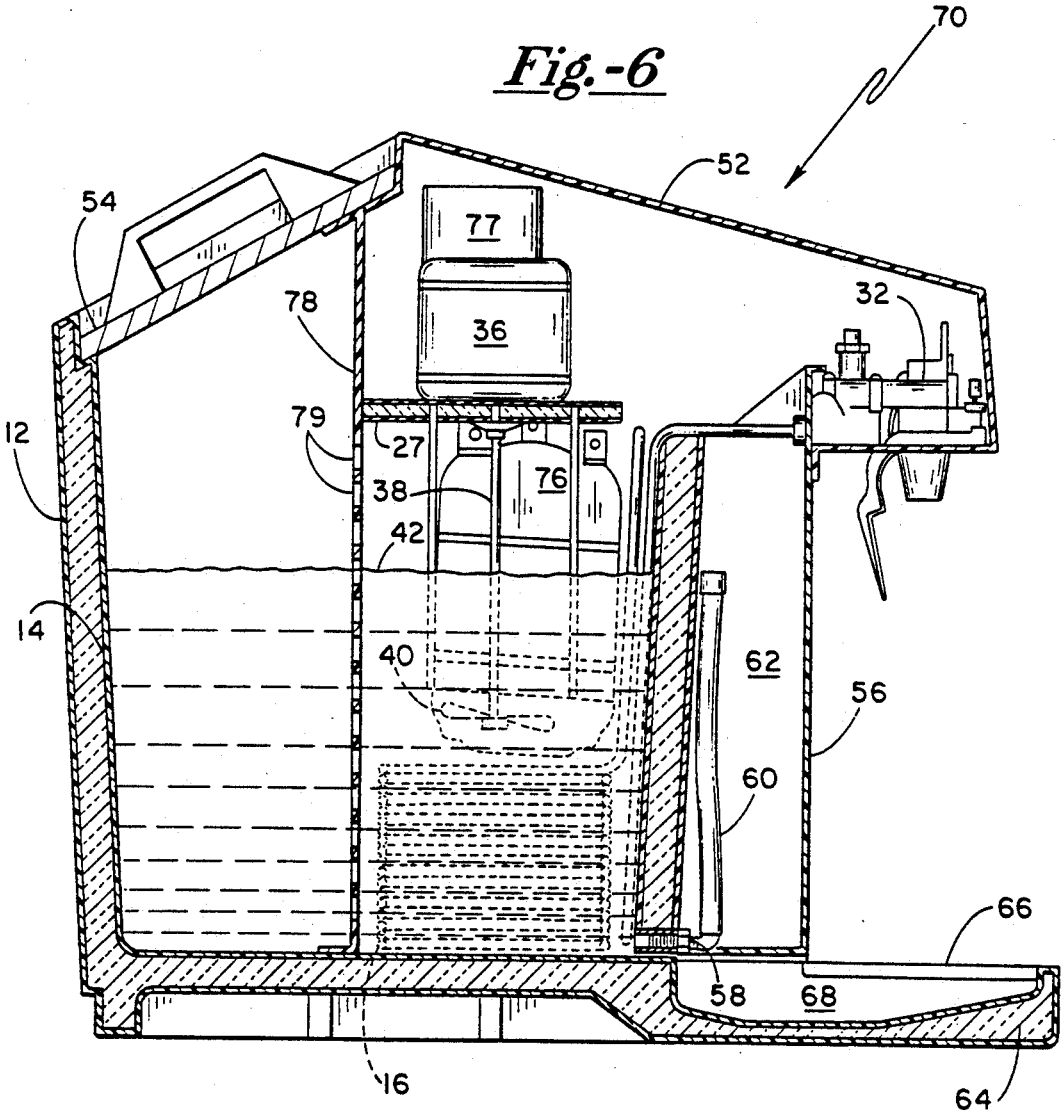
FIG. 6 shows a side cross-sectional view of an alternate embodiment of the present invention.
Figure 7:
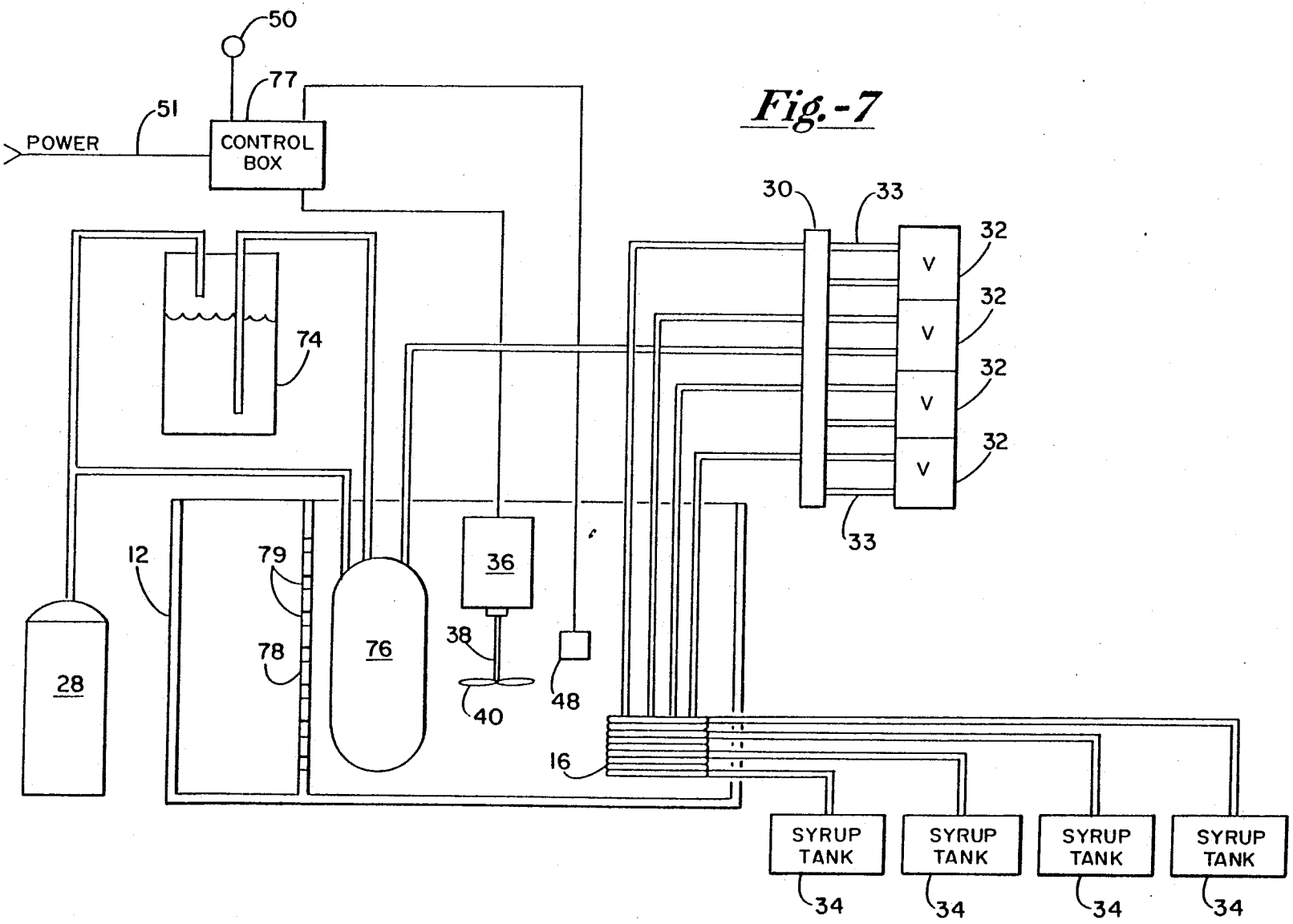
FIG. 7 shows a schematic diagram of the embodiment of FIG. 6.

Referring to FIGS. 6 and 7, an alternate embodiment 70 of the present invention is shown. Those of skill will understand that water pump 26 can be eliminated entirely if a motorless carbonating strategy is used, as seen for example in U.S. Pat. No. 3,394,847. In this approach a water tank 74 holding potable water is pressurized by gas source 28 and connected to a modified carbonator tank 76. As carbonated water is withdrawn from tank 76 further carbon dioxide gas and potable water automatically flow into tank 76. Carbonation is further enhanced where the carbonator tank, as with the present invention, is submerged in a cold water bath, and where the pressure of the compressed carbon dioxide gas supply is utilized to promote such carbonation. A control 77 therefore, has no carbonator level control function, and only operates agitator 36, temperature sensor 48 and light 50. Dispenser 70 also illustrates the use of a partition wall 78 instead of a basket 20. Wall 78, like basket 20, divides tank 14 into two halves, and includes a plurality of holes 79 there through for permitting fluid communication between the two halves.

Figure 8:
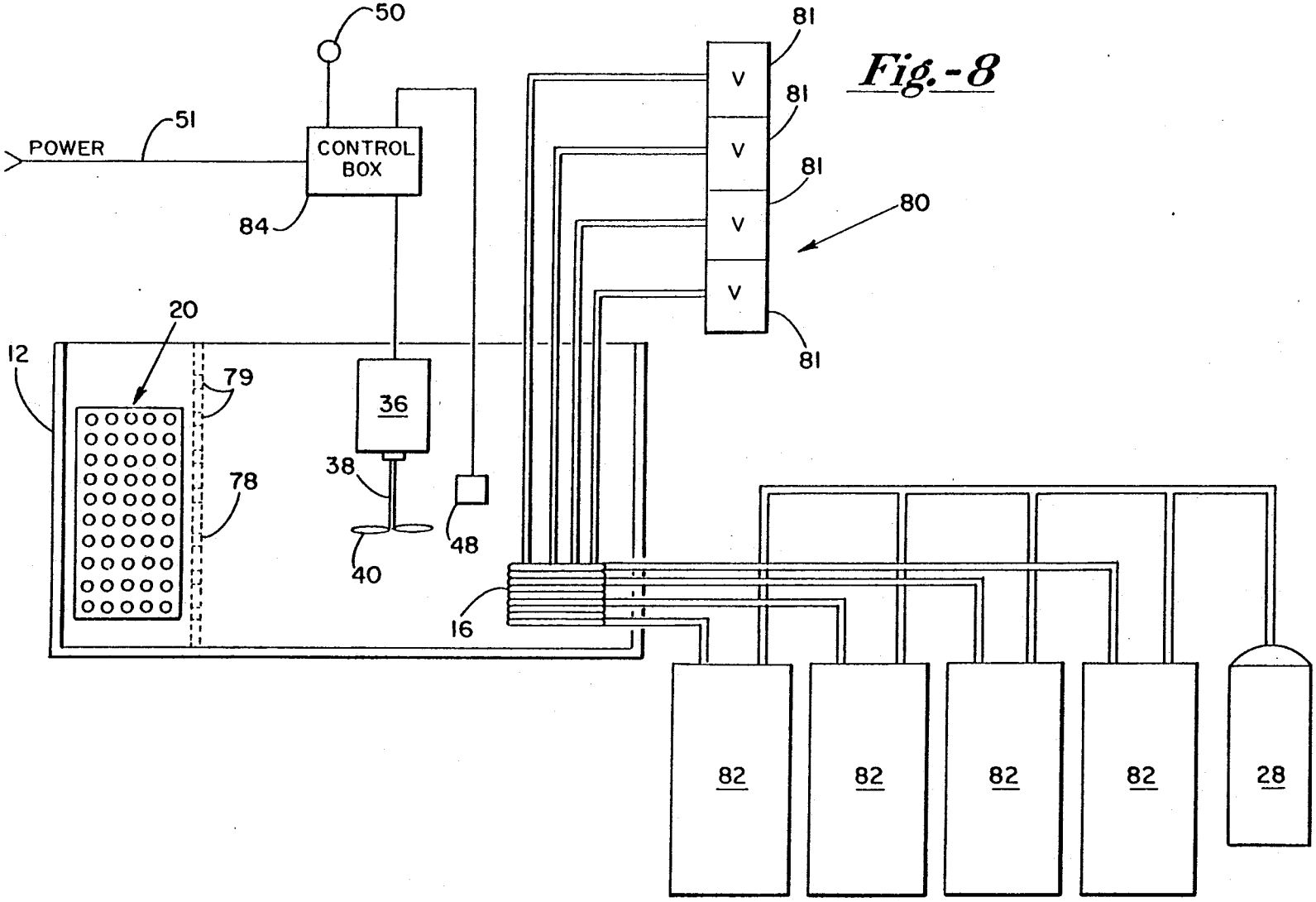
FIG. 8 shows a schematic diagram of a further alternate embodiment the present invention.

FIG. 8 show a further alternate embodiment 80 of the present invention being of the pre-mix type. In such an embodiment a carbonator is not needed and the valves 81 are manual pre-mix valves connected to individual pre-mix tanks 82. A control 84, would also only regulate the operation of agitator 36, sensor 48 and light 50. As in all the embodiments herein, an apertured partition wall or basket approach could be utilized.

In operation, basket 20 is removed from tank 14 through lid 54 and tank 14 is then filled with a volume of water. Basket 20 is then filled with ice and replaced into tank 14, after which lid 54 is replaced on housing 52. A volume of water held in tank 14 will be displaced by an equal volume represented by the ice and basket 20. Any excess water will flow out of tube 60. Operation of agitator 36 causes the water to flow around basket 20 and through holes 22 for providing heat exchange with coils 16. It can be seen that collar 23 provides for additional spacing between basket 20 and tank 14 to facilitate water such water flow. At this point, dispenser 10 is operating in the same manner as a traditional ice-bank system, but without the associated refrigeration equipment. The level of water in carbonator 18 is regulated by level sensor 44 and control 46, as is well understood in the art, and the cooled beverage components of carbonated water and syrup are supplied to valves 32 where they are mixed and dispensed into a suitable receptacle generally resting on grate 66.

As is also known, further reductions in the requirement for external electrical power can be had, if, as with embodiment 70, carbonator 76 is of the motorless of type. Since control 46, sensor 48, light 50 and agitator 36 can be operated for an extended period of time by a relatively low voltage battery power source, for example, as commonly available on a food vending truck, and as valves 32 are manually operated as opposed to being solenoid operated, the overall electrical energy requirement of the present invention can be made quite low. Thus, dispenser 10 or 70 can be operated economically on a portable basis wherein no connection to an external conventional high voltage utility generated electrical power source, or its equivalent, is required. Wall 78 serves to create an ice storage area in tank 14 wherein the ice held therein also serves to create, as does basket 20, an equivalent of an ice bank. Thus, ice can simply be loaded into tank 14 through lid as needed. It will be appreciated by those of skill that basket 20 has the advantage of permitting easier and more rapid replacement of a full load of ice, particularly where replacement is desired before the previous ice has fully melted. Basket 20 also provides for replacing with a more accurately measured amount of ice so as to minimize any overflow through drain 58. Also, basket 20 can hold a measured amount of ice so that a temporary overly high water level that could damage internal electrical components is less likely to occur in the event that water in tank 14 were displaced at a rate faster than could be drained away.

Embodiment 80 works in the same manner as described above for dispenser 10 with respect to basket 20 or wall 78, and the heat exchange of coils 16. Dispenser 80 is further simplified in that it is a pre-mix dispenser and no carbonator is required. Thus, dispenser 80 is also readily portable as it requires a relatively small amount of electrical power to operate, and is structurally simple, and therefore, economical to purchase and operate.

Controls 46, 77 and 84 provide for signaling if the water bath is too warm. Each such control is set or programmed wherein, if a predetermined temperature of the water in the water bath is reached, agitator 36 is operated for a period of time until the temperature of the water in tank 14, as sensed by sensor 48, goes below that predetermined temperature. If however, agitator 36 operates for a predetermined period of time without the sensed temperature going below the predetermined temperature, light 50 is turned on. In this manner, the dispensers of the present invention can signal that no more or insufficient cooling is occurring, which probably indicates a low ice situation. Various other related strategies of agitator operational control based upon sensed temperature or pre-defined on and off periods, are well known in the art. Thus, signaling means 50 can be operated simply on the basis of a predetermined temperature being equaled or exceeded for a predetermined period of time, independent of agitator operation.

It will be understood that those of skill in the art can make various modifications to the present invention and still remain within the spirit and scope thereof.

What is claimed is:

1. A beverage dispenser, comprising:

an exterior housing defining an internal water tank for holding a volume of water therein and the tank having a partition wall, the wall defining a first ice retaining area and a second area in the tank, and the wall having a plurality of holes therein for permitting fluid communication of the water between the first and second areas, the second area retaining one or more beverage heat exchange coils therein, the one or more coils providing for a flow of beverage from one or more sources thereof to one or more beverage dispensing valves, an agitating means for agitating water held in the second area for creating a flow of water between the first area and the second area through the partition wall holes for facilitating cooling of the coils by heat exchange with ice retained in the first area.

2. The dispenser as defined in claim 1, and the exterior housing having a top enclosing portion for covering the tank and the enclosing portion having an access door therein through which door ice can be added to the ice retaining area.

3. The dispenser as defined in claim 1, and further including control means for regulating the operation of the agitator.

4. The dispenser as defined in claim 3, and further including a temperature sensing means in the water tank and a temperature signalling means, the temperature sensing and signalling means connected to the control means so that if the temperature sensed by the temperature sensing means is greater than a predetermined temperature for a predetermined period of time the temperature signalling means is operated for indicating insufficient ice.

5. A beverage dispenser, comprising:

an exterior housing defining an internal water tank for holding a volume of water therein and the tank having a first area and a second area therein, an ice retaining basket means for removable placement in the first area and having a plurality of holes, the second area retaining one or more beverage heat exchange coils therein, the one or more coils providing for a flow of beverage from one or more sources thereof to one or more beverage dispensing valves, an agitating means for agitating water in the second area for creating a flow of water between the first area and the second area through the basket means holes for facilitating cooling of the coils by heat exchange with ice retained in the basket means.

6. The dispenser as defined in claim 5, and the exterior housing having a top enclosing portion for covering the tank and the enclosing portion having an access door therein through which door ice can be added to the ice retaining area.

7. The dispenser as defined in claim 5, and further including control means for regulating the operation of the agitator.

8. The dispenser as defined in claim 7, and further including a temperature sensing means in the water tank and a temperature signalling means, the temperature sensing and signalling means connected to the control means so that if the temperature sensed by the temperature sensing means is greater than a predetermined temperature for a predetermined period of time the temperature signalling means is operated for indicating insufficient ice.

9. A beverage dispenser, comprising:

an exterior housing defining an internal water tank for holding a volume of water therein and the tank having a first area and a second area therein, an ice retaining basket means for removable placement in the first area and having a plurality of holes, the second area retaining one or more beverage heat exchange coils therein, the one or more coils providing for a flow of beverage from one or more sources thereof to one or more beverage dispensing valves, a carbonator retained in the second tank area and in contact with the water therein, the carbonator for providing carbonated water to the valves, an agitating means for agitating water in the second area for creating a flow of water through the basket means holes between the first area and the second area for facilitating cooling of the coils and carbonator by heat exchange with ice retained in the basket means.

10. The dispenser as defined in claim 9, and the exterior housing having a top enclosing portion for covering the tank and the enclosing portion having an access door therein through which door ice can be added to the ice retaining area.

11. The dispenser as defined in claim 9, and further including control means for regulating the operation of the agitating means.

12. The dispenser as defined in claim 11, and further including a temperature sensing means in the water tank and a temperature signalling means, the temperature sensing and signalling means connected to the control means so that if the temperature sensed by the temperature sensing means is greater than a predetermined temperature for a predetermined period of time the temperature signalling means is operated for indicating an over warm condition of the water in the tank.

* * * * *